United States Patent [19]

Nebell

[11] 4,194,958

[45] Mar. 25, 1980

[54] ARRANGEMENT FOR COMPENSATING FOR DETRIMENTAL MAGNETIC INFLUENCE BETWEEN TWO OR MORE ROWS OF TRANSVERSE ELECTROLYTIC POTS OR CELLS FOR PRODUCING ALUMINUM, BY ELECTROLYTIC REDUCTION

[75] Inventor: Hans G. T. Nebell, Snarøya, Norway

[73] Assignee: Ardal og Sunndal Verk a. s., Oslo, Norway

[21] Appl. No.: 949,381

[22] Filed: Oct. 6, 1978

[30] Foreign Application Priority Data

Oct. 19, 1977 [NO] Norway ..... 773589

[51] Int. Cl.[2] ..... C25C 3/16; C25C 3/06

[52] U.S. Cl. ..... 204/243 M; 204/244

[58] Field of Search ..... 204/243 R, 243 M, 244–247, 204/67

[56] References Cited

U.S. PATENT DOCUMENTS

| | | | |
|---|---|---|---|
| 3,415,724 | 12/1968 | Heaton et al. | 204/244 X |
| 3,616,317 | 10/1971 | McLellan et al. | 204/244 X |
| 3,756,938 | 9/1973 | Nebell | 204/243 M |
| 4,049,528 | 9/1977 | Morel et al. | 204/243 M |
| 4,072,597 | 2/1978 | Morel et al. | 204/243 M |
| 4,090,930 | 5/1978 | Morel et al. | 204/244 X |

*Primary Examiner*—John H. Mack
*Assistant Examiner*—D. R. Valentine
*Attorney, Agent, or Firm*—Wenderoth, Lind & Ponack

[57] ABSTRACT

An arrangement is provided for compensation for detrimental magnetic influence between two or more rows of transverse electrolytic pots or cells for producing aluminum, by electrolytic reduction in a molten bath, in which most of the current conducted from the rear side of a pot in the pot row to the succeeding pot in the row, is carried by two or more conductors underneath the pot. Another and smaller proportion of the current conducted to the succeeding pot in the row is conducted in its entirety around that short side of the pot which faces the magnetically dominating adjacent pot row. Preferably, this smaller proportion of the current amounts to a maximum of twenty percent of the total electrolysis current.

2 Claims, 3 Drawing Figures

ARRANGEMENT FOR COMPENSATING FOR DETRIMENTAL MAGNETIC INFLUENCE BETWEEN TWO OR MORE ROWS OF TRANSVERSE ELECTROLYTIC POTS OR CELLS FOR PRODUCING ALUMINUM, BY ELECTROLYTIC REDUCTION

BACKGROUND OF THE INVENTION

This invention relates to an arrangement for compensating for the detrimental magnetic influence between two or more rows of transversally oriented electrolytic cells for producing aluminum by electrolytic reduction in a molten bath.

In U.S. Pat. No. 3,756,938 there is described a method concerned with the compensation of corresponding detrimental magnetic influence between rows of cells or pots being longitudinally oriented, but this method cannot be directly transferred to transverse pots because of the great difference in the structure of the bus bar system.

There are previously known various precautions for reducing or eliminating the detrimental magnetic influence between rows of transverse electrolytic cells or pots for producing aluminum by electrolytic reduction. In German Offenlegungsschrift No. 2.653.643 there is described a method according to which the current being conducted from the rear side of a pot in a row to the succeeding pot in the row, is divided into two portions, such that a larger portion is conducted around that short side of the pot facing the adjacent row than the portion being conducted around the opposite short side.

SUMMARY OF THE INVENTION

In contrast to the method described in the above German publication, the present invention is in particular directed to transverse electrolytic cells or pots in which most of the current being conducted from the rear side of a pot in the pot row to the succeeding pot in the row, is carried by two or more bus bars underneath the pot.

In principle the present invention is based upon an arrangement in which another and smaller proportion of the current being led to the succeeding pot in the row, in its entirety is conducted around that short side which faces the adjacent row, i.e. that adjacent row which has a dominating magnetic influence on the pot row considered. This proportion of the current is carried by a current conductor which is preferably lying directly outside the cathode metal pad so that the current flowing in the conductor creates only a vertical field which is directed oppositely to the field created by the adjacent row.

The necessary current amperage in this conductor, which is designated compensation bus bar in the following description, depends strongly upon the position of the pot rows, but in general terms the distance between rows of transverse pots in practice is larger than between rows of longitudinal pots, so that a smaller proportion of the electrolysis current, such as up to twenty percent thereof, is required for the compensation here described.

BRIEF DESCRIPTION OF THE DRAWINGS

In the following description the invention shall be explained in more detail with reference to the drawings, in which.

DETAILED DESCRIPTION OF THE INVENTION

Figure 1:
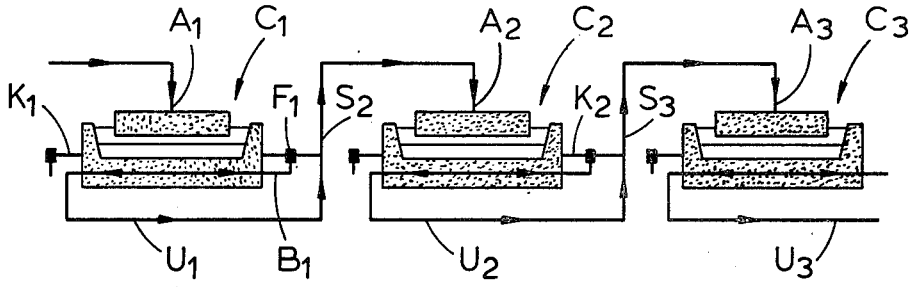
FIG. 1 is a purely schematic longitudinal section through three pots in a pot line.
Figure 2:
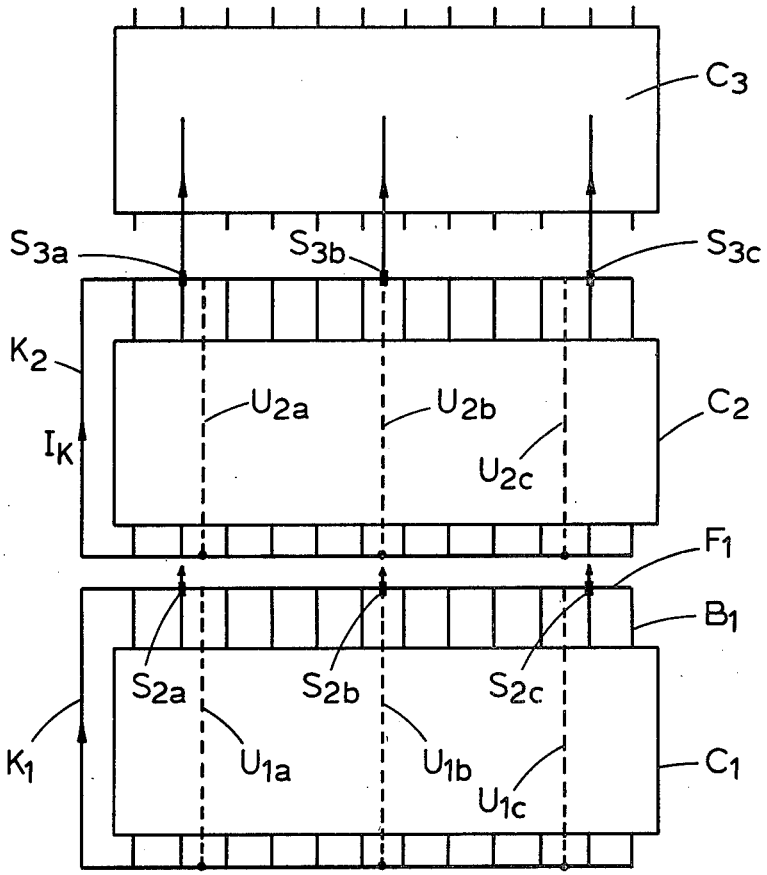
FIG. 2 is a plan view of the arrangement of FIG. 1.

The three pots $C_1$, $C_2$ and $C_3$ shown in FIGS. 1 and 2 are just a small portion of a larger number of pots constituting a pot line in a pot plant in which there is at least one other pot line parallel to the pot line in which pots $C_1$, $C_2$ and $C_3$ are included, and such other adjacent pot line or pot lines have a current direction which is opposite to the current direction through pots $C_1$, $C_2$ and $C_3$. In FIG. 1 the current direction is from left to right and in FIG. 2 the current direction is from the bottom and upwards.

In FIG. 1 the anode or anode supply to each pot is shown at $A_1$, $A_2$ and $A_3$, respectively. There is a riser conductor $S_2$ connected to anode $A_2$ and a riser conductor $S_3$ connected to anode $A_3$. As shown in FIG. 2 there may be three anode riser conductors $S_2a$, $S_2b$ and $S_2c$ for the current supply to pot $C_2$ and three anode riser conductors $S_3a$, $S_3b$ and $S_3c$ for the current supply to pot $C_3$.

Along the longitudinal side of each pot there is a number of cathode taps of which one cathode tap $B_1$ is indicated on pot $C_1$. A major portion of the current from the cathode taps on the rear or upstream side of each pot is conducted by bus bars underneath the pot to the riser conductors for the next pot in the row. In FIG. 1 these bus bars underneath the pots $C_1$, $C_2$ and $C_3$ are shown at $U_1$, $U_2$ and $U_3$, respectively. In FIG. 2 there are shown three such bus bars $U_1a$, $U_1b$ and $U_1c$ underneath pot $C_1$ as well as bus bars $U_2a$, $U_2b$ and $U_2c$ underneath pot $C_2$.

According to the invention there is arranged a compensation bus bar $K_1$ and $K_2$ for pots $C_1$ and $C_2$, respectively, which compensation bus bar is located around or along one short side of these pots. These compensation bus bars are so located as to face the adjacent pot row the magnetic influence of which is dominating at the position of the pot row considered. Moreover, the compensation bus bars $K_1$ and $K_2$ should be arranged as close to the pot shell of pots $C_1$ and $C_2$, respectively, as possible to have the desired effect thereon.

In a practical case the compensation bus bars may conduct for example 15–20 kA whereas the three bus bars in FIG. 2 underneath the pots each may conduct 25–30 kA.

In FIG. 2 the current in the compensation bus bars is designated $I_K$.

Figure 3:
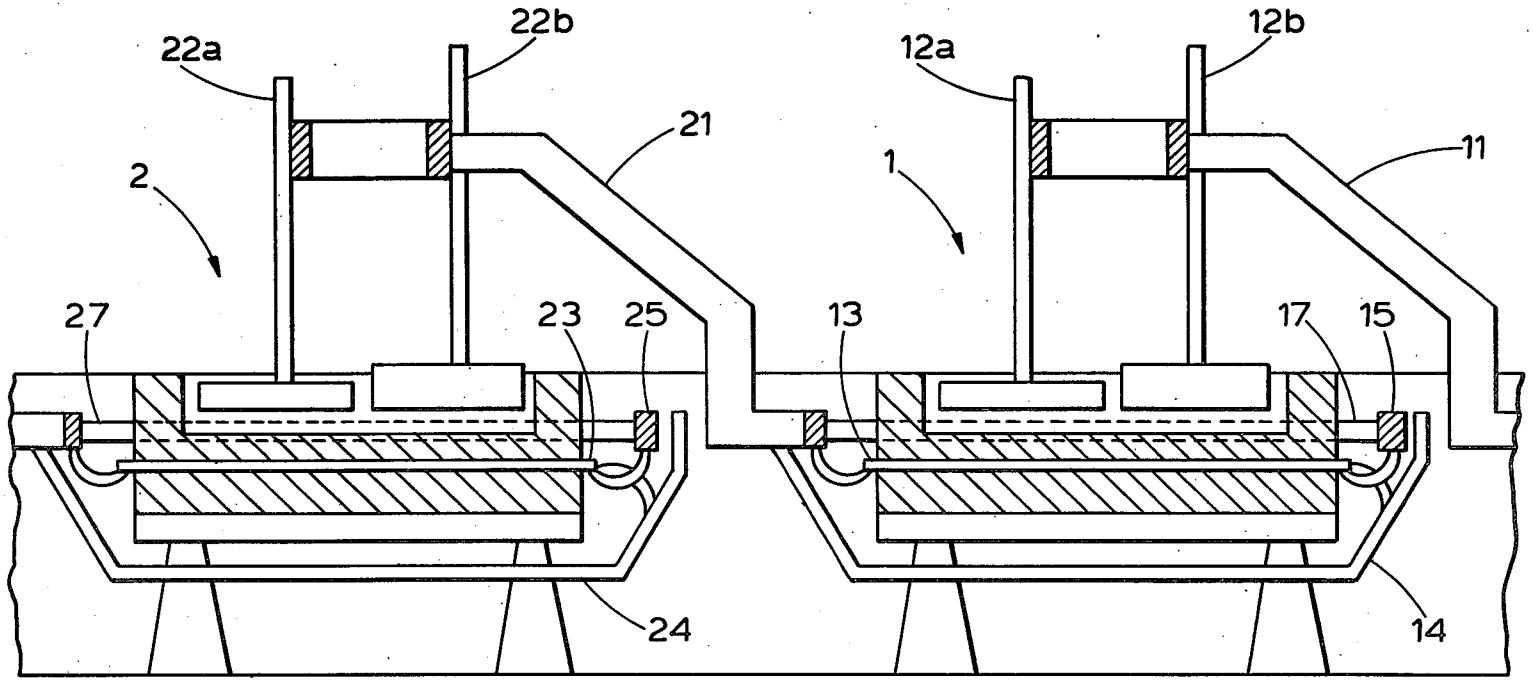
FIG. 3 is a transverse section in more detail illustrating how the current supply arrangement according to the invention can be designed in practice in connection with two electrolytic cells or pots.

FIG. 3 shows schematically and partly in transverse section two transverse electrolytic cells or pots 1 and 2 with a related bus bar system. This bus bar system consists of riser conductors 11 and 21, respectively, which conduct the current to the anodes through anode bolts 12*a*, 12*b* and 22*a*, 22*b*, respectively. On the rear or upstream side of the pot 1 the current from the cathode taps is collected in a transverse bus bar 15 (corresponding to bus bar $F_1$ in FIGS. 1 and 2) and is carried partly underneath the pot in bus bars 14 and partly in a compensation bus bar 17 along the short side of the pot to the lower end of the anode riser 21 for the succeeding pot. As shown in FIG. 3 this compensation bus bar is lying at about the level of the metal sump or metal pad at the bottom of the pot. Subdivision of the current between the bus bars 14 underneath the pot and the compensation bus bar 17 around the short side of the pot is determined for example by a suitable choice of the number of cathode taps 13 which are connected to the respective bus bars. At pot 2 there is shown a corresponding arrangement of cathode taps 23, bus bars 24 underneath the pot, a collecting or transverse bus bar 25 and a compensation bus bar 27.

It will be obvious to an expert in the field that the drawings only diagrammatically illustrate the substantial features of the invention, as details of the pot arrangement and the current supply are not shown. Moreover, it is obvious that the way the various conductors are shown in the drawings does not result in the most optimized bus bar structure for all sizes or pots. In principle it is an advantage to increase the number of bus bars underneath the pot the larger the pot is, and in such case it will also be advantageous to move the two outermost bus bars underneath the pot outwardly close to both ends of the pot.

If there is ample space it is fully possible to arrange several pot rows, for example four pot rows, in such a way that only the two outermost rows will need compensation. Thus, the necessary compensation current will vary and may be as much as twenty percent of the total electrolysis current.

I claim:

1. In an electrolytic pot line for producing aluminum by electrolytic reduction, said pot line being of the type having at least first and second parallel rows of pots, means for supplying electric current to said pot line for the operation of said pots, each of said pots extending transverse to the longitudinal direction of the respective said row and having upstream and downstream, taken in the direction of current flow, longer sides extending transverse to said longitudinal direction and first and second shorter sides extending parallel to said longitudinal direction, each said pot having an anode and a cathode, said cathode of each said pot having on said upstream and downstream longer sides thereof a plurality of cathode taps, each said pot having upstream and downstream transverse bus bars extending transverse to said direction of the respective said row for collecting electric current from said cathode taps on said respective upstream and downstream longer sides, each said pot having at least two current conductors extending underneath said pot for carrying a first major portion of the electric current from the respective said upstream transverse bus bar to the next succeeding pot in the respective said row, whereby the current flowing through a first said row may be subjected to a detrimental magnetic influence by current flowing through a second of said rows positioned laterally on one side of said first row, the improvement of a conductor arrangement for compensating for said detrimental magnetic influence, said conductor arrangement comprising:

for each said pot in said first row, compensation conductor means for carrying a second minor portion of said electric current from said respective upstream transverse bus bar to said next succeeding pot in said first row, said compensation conductor means entirely extending along the respective said shorter side of said pot facing said second row.

2. The improvement claimed in claim 1, wherein said compensation conductor means carries a maximum of 20% of the total electrolysis current.

* * * * *